United States Patent [19]

Helfert et al.

[11] 4,294,576

[45] Oct. 13, 1981

[54] REMOVAL OF OLIGOMER DEPOSITS FROM TEXTILE MATERIALS

[75] Inventors: Herbert Helfert, Frankenthal; Friedrich Reinert, Wachenheim; Paul Richter, Friedelsheim; Michele Vescia, Limburgerhof; Dieter Wegerle, Mannheim, all of Fed. Rep. of Germany

[73] Assignee: BASF Aktiengesellschaft, Ludwigshafen, Fed. Rep. of Germany

[21] Appl. No.: 152,178

[22] Filed: May 22, 1980

[30] Foreign Application Priority Data

Jun. 23, 1979 [DE] Fed. Rep. of Germany ..... 2925477

[51] Int. Cl.[3] ..... D06L 1/12; D06P 5/02; C11D 1/62

[52] U.S. Cl. ..... 8/137.5; 8/137; 8/606; 252/547

[58] Field of Search ..... 8/137, 137.5, 606; 252/547

[56] References Cited

U.S. PATENT DOCUMENTS

| | | | |
|---|---|---|---|
| 2,587,597 | 3/1952 | Cook et al. | 8/137 |
| 2,950,253 | 8/1960 | Kling | 252/542 |
| 3,684,431 | 8/1972 | Bischof et al. | 8/137 |
| 3,816,321 | 6/1974 | Kleinschmidt | 8/137 |
| 4,152,272 | 5/1979 | Young | 8/137 |
| 4,155,856 | 5/1979 | Reinert et al. | 8/137 |

FOREIGN PATENT DOCUMENTS

| | | | |
|---|---|---|---|
| 2641608 | 3/1978 | Fed. Rep. of Germany | 8/930 |
| 44-17596 | 8/1969 | Japan | 8/137 |

*Primary Examiner*—Joseph L. Schofer
*Assistant Examiner*—Maria Parrish Tungol
*Attorney, Agent, or Firm*—Oblon, Fisher, Spivak, McClelland & Maier

[57] ABSTRACT

A process for removing oligomer deposits from dyed and non-dyed textile materials which consist of polyester fibers or of blends of these fibers with other fibers, and from dyeing machinery, by a treatment with an aqueous, alkaline liquor which contains from 0.1 to 10 g/l of a quaternary ammonium compound carrying not less than two $C_6$-$C_{22}$-alkyl or -alkenyl groups on the quaternary nitrogen, at up to 100° C. The oligomers are hydrolyzed and are removed together with the treatment liquor.

10 Claims, No Drawings

REMOVAL OF OLIGOMER DEPOSITS FROM TEXTILE MATERIALS

The present invention relates to a process for removing oligomer deposits from textile materials which consist of polyester fibers or of blends of these fibers with other fibers, and from dyeing machinery, by treatment with an aqueous alkaline liquor at an elevated temperature.

Polyester fibers contain oligomers which frequently cause difficulties in processing, and dyeing, these fibers. In fibers of linear polyesters obtained from terephthalic acid and glycol, it is in particular the cyclic trimer which causes problems in processing or finishing of the polyester fibers. For example, during dyeing, oligomers which are only sparingly watersoluble deposit in the dyeing machine and also on the material to be dyed. A proportion of the oligomers originating from the polyester remains finely dispersed in the liquor. The oligomer deposits on the polyester material frequently detract from the levelness of the dyed material and from the appearance of the goods. Furthermore, they cause considerable problems during further processing, for example during spinning, re-reeling, weaving or making-up, due to dusting and due to increased friction between the fibers or between the fibers and parts of the processing machinery. Various measures have been proposed for reducing the difficulties mentioned. A summary of various measures for preventing oligomer deposits on, or removing oligomer deposits from, polyester textiles is to be found, for example, in German Laid-Open Application DOS 2,641,608, pages 2–4. However, the known processes are not fully satisfactory. Even the process, disclosed in German Laid-Open Application DOS No. 1,641,608, for pre-cleaning and dyeing polyester textiles, wherein the pre-cleaning is carried out at above 100° C. in an alkaline medium, is not free from disadvantages. It entails the inclusion of an additional process step and, under the conditions proposed, there is the danger of an adverse effect on the polyester fibers. For example, according to Melliand Textilberichte 60 (1979), 188, a reduction in tenacity may occur. Furthermore, the dye receptivity of the fibers may be affected, resulting in non-level dyeing.

German Laid-Open Application DOS No. 2,834,413 discloses a process for after-treating textiles containing dyed polyester fibers, wherein the textile is treated with an aqueous emulsion of an oligomer-dissolving substance at a temperature below the glass transition temperature of the polyester fibers. As examples of substances which are capable of dissolving oligomers off the fibers, the DOS mentions aliphatic and aromatic halohydrocarbons and non-ionic adducts of not more than 10 moles of alkylene oxide with alcohols, fatty acids or amines of 8 to 22 carbon atoms, or with phenols (which may or may not be alkyl-substituted or phenyl-substituted), the cloud point of the adducts being lower than the temperature at which they are to be used. However, it is not possible to remove particularly firmly adhering oligomers from polyester textiles by this process.

To remove oligomer deposits from dyeing machinery, aqueous sodium hydroxide solution, where necessary in combination with solvents, e.g. trichlorobenzene or N-methylpyrrolidone, is used in industrial practice. These processes require high temperatures and long treatment times, and are complicated to carry out.

It is an object of the present invention to provide a process of the type described at the outset whereby the oligomers can be hydrolyzed substantially completely under milder conditions than in conventional processes, so that there are no potentially troublesome deposits left either on the textile or in the machine.

In accordance with the invention, this object is achieved if the liquors contain quaternary ammonium compounds which carry not less than two $C_6$–$C_{22}$-alkyl or -alkenyl groups on the quaternary nitrogen.

The process allows oligomers to be removed both from textiles containing undyed polyester fibers and from dyed or optically brightened material, as well as from dyeing machinery. Preferably, the process according to the invention is employed for dyed textiles which consist of polyester fibers or of a blend of these fibers with other fibers, and in which a heat treatment has caused oligomers to migrate to the fiber surface or to pass from the fibers into the dyeing liquor and deposit, from the latter, on the textile or in the machine. When dyeing polyester fibers by the exhaustion process under high temperature conditions, at 125°–135° C., in the presence or absence of carriers, there is increased deposition of oligomers on the material to be dyed. These oligomer deposits originate from the dyebath, but oligomers also migrate, under the dyeing conditions, from the interior of the polyester fibers to their surface, and as a result cause dyeing problems. The hydrolytic cleavage by the process according to the invention substantially removes the oligomers which have deposited on the dyed material and in the machine.

For the purposes of the invention, textiles are fibers which may be in any state of processing, for example as slivers, flock, tops, staple fiber yarns, filaments, mesh fabrics, knitted fabrics, woven fabrics and nonwovens. The polyester fibers may also be present as a blend with other fibers, e.g. as polyester/cotton, polyester/-regenerated cellulose, polyester/wool, polyester/nylon and polyester/polyacrylonitrile fibers. In all cases, the polyester fibers are dyed with disperse dyes and the other fibers—in the case of fiber blends—are dyed with dyes of various catergories suitable for the particular fibers—for example with vat dyes or reactive dyes, and under certain conditions also with disperse dyes, in the case of cellulose fibers, with basic dyes in the case of polyacrylonitrile fibers and with disperse dyes, anionic dyes or metal complex dyes in the case of nylon fibers.

The polyester fibers are dyed by the exhaustion method, at from 80° to 145° C. At above 100° C., the process is carried out under pressure in conventional dyeing apparatus. The usual dyeing accelerators, in conventional amounts, may be employed, with or without other dyeing assistants, eg. dispersants, wetting agents, lubricants and anti-foam agents. Examples of suitable dyeing accelerators include diphenyl, chlorobenzenes, o-phenylphenol, reaction products of 1 mole of chlorophenol with from 1 to 3 moles of ethylene oxide, and salicylic acid esters. As a rule, the polyester fibers are dyed in liquors which have a pH of from 4 to 6.

The oligomers which are present on the polyester fibers after the latter have been dyed by the exhaustion process are removed, according to the invention, in an after-treatment step separate from the dyeing process, in which the dyed material is treated with an alkaline aqueous liquor which contains one or more quaternary ammonium compounds having not less than two $C_6$–$C_{22}$-alkyl or -alkenyl groups on the quaternary nitrogen. Suitable quaternary ammonium compounds may contain one or more quaternary nitrogens. Quaternary ammonium compounds which hydrolyze cyclic trimers particularly efficiently contain three $C_8$–$C_{14}$-alkyl groups on the quaternary nitrogen. The fourth substituent on the quaternary nitrogen is preferably alkyl, for example of 1 to 4 carbon atoms. Other substituents are also suitable, for example aryl groups, eg. phenyl or alkylphenyl, aralkyl groups, eg. benzyl, and substituents of the formula R—CO—X—$(CH_2)_n$—, where R is $C_1$–$C_{18}$-alkyl, X is —NH— or —O— and n is from 1 to 6. The anion of the quaternary ammonium compound as a rule has no substantial effect on the activity of the product in respect of removing the oligomers by the process according to the invention. Examples of suitable anions are chloride, bromide, methosulfate and ethosulfate. It is also possible to use the free quaternary ammonium base. Examples of suitable quaternary ammonium compounds are di-(iso-decyl)-dimethylammonium methosulfate, tri-(isodecyl)-methylammonium methosulfate, tri-(n-octyl)-methylammonium chloride, tri-(n-octyl)-butylammonium chloride, tri-(n-octyl)-benzylammonium chloride, di-(iso-decyl)-diethylammonium ethosulfate, tri-(n-dodecyl)-methylammonium iodide, di-(n-octyl)-methylbenzylammonium bromide, di-(iso-tridecyl)-dimethylammonium methosulfate, dipalmityl-benzyl-methylammonium chloride, dipalmityldimethylammonium chloride, distearyl-dimethylammonium chloride, di-(palm kernel alkyl)-methylbenzylammonium chloride, dioleyl-dibutylammonium bromide, dioleyldimethylammonium chloride, dioleylbenzyl-methylammonium chloride, tetra-(n-octyl)-ammonium bromide, tri-(n-octyl)-methylammonium hydroxide, 1,3,5-tris-(γ-didodecylmethylammonium-propyl)-hexahydrotriazine

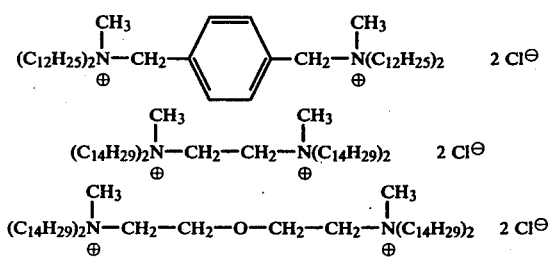

and compounds of the formula

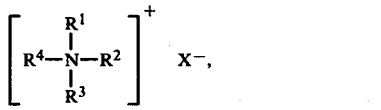

where $R^1$ and $R^2$ are $C_8$–$C_{18}$-alkyl or $C_8$–$C_{18}$-alkenyl, $R^3$ is $C_1$–$C_4$-alkyl, benzyl or phenyl or is as defined for $R^4$, $R^4$ is $+CH_2—CH_2—O+_nH$, n is from 1 to 40 and $X^-$ is $Cl^-$, $Br^-$, $I^-$, $OH^-$, $CH_3OSO_3^-$, $C_2H_5OSO_3^-$ or $(CH_3O)_2PO_2^-$.

The suitable quaternary ammonium compounds are employed in the liquor in an amount of from 0.1 to 10 g/l, preferably from 0.3 to 3 g/l. Where the quaternary ammonium compounds are water-insoluble, they are employed in an emulsified form. Emulsification can be effected, for example, by adding the quaternary ammonium compound, dissolved in a monohydric alcohol, dimethylformamide, glycol, polyethylene glycol, glycerol, glycol monomethyl ether, methyldiglycol or some other polar solvent, to the aqueous after-treatment liquor, with vigorous mixing. Quaternary ammonium compounds containing alkylene oxide units are as a rule self-emulsifying. The use of these compounds is therefore particularly simple and in general does not require the addition of emulsifiers. In cases where the compounds are not self-emulsifying, a suitable emulsifier must be used to prepare a stable emulsion. For this, cationic, nonionic or anionic emulsifiers may be employed, provided they do not produce a precipitate with the quaternary ammonium salt.

Examples of suitable cationic emulsifiers are quaternized oxyalkylated fatty amines, for example, reaction products of oleylamine and from 6 to 10 moles of ethylene oxide, which have been completely quaternized with dimethyl sulfate or diethyl sulfate, or coconut fatty acid γ-dimethylaminopropylamide which has been quaternized with epichlorohydrin.

Examples of suitable nonionic emulsifiers are oxyethylation products of fatty alcohols, $C_1$–$C_{12}$-alkylphenols, fatty amines and fatty acids which are obtained by reacting the said compounds with from 5 to 50, preferably from 15 to 45, moles of ethylene oxide. The fatty alcohols, fatty amines and fatty acids each are of 8 to 18 carbon atoms. Reaction products of castor oil with ethylene oxide in the molar ratio of castor oil:ethylene oxide of from 1:5 to 1:50 are also suitable nonionic emulsifiers. Stable emulsions of the quaternary ammonium compounds are obtained if the weight ratio of emulsifier to quaternary compound is from 0.1 to 2. It is also possible to use mixtures of different emulsifiers, for example mixtures of cationic and nonionic emulsifiers, or of nonionic and anionic emulsifiers, provided the use of the anionic emulsifiers together with the quaternary ammonium salts does not cause precipitation to occur.

Where the process according to the invention is employed for removing oligomers from dyed polyester material, the process can advantageously be carried out together with the conventional reductive final cleaning of polyester textiles. In the said reductive final cleaning, the textile is treated with an aqueous alkaline liquor which contains a reducing agent, eg. sodium dithionite, thiourea dioxide, sodium boranate or reductones, at from about 30° C. to the boiling point of the liquor. An alternative procedure is first to carry out the conventional reductive final cleaning of the dyed polyester and then to effect the removal of the oligomers in accordance with the invention. Equally, the converse sequence of treatment stages is possible, in which case the oligomers are first hydrolyzed and the conventional reductive final cleaning is then carried out in the same bath or in a separate bath. In order to remove the oligomers from non-dyed or dyed polyester material, the treatment of the textile material, or of the dyeing machine, in accordance with the invention is carried out at from 30° to 100° C. The time required for removing the oligomers depends in particular on the temperature of the treatment liquor. Higher temperatures require shorter treatment times. The treatment times are from 1 minute to 24 hours whilst the temperature is preferably from 70° to 90° C.

The oligomers are removed with liquors, containing quaternary ammonium salts, which have an alkaline pH.

The pH is from 8 to 14 and is adjusted to the appropriate value by addition of a base, such as sodium hydroxide solution or potassium hydroxide solution.

The Examples which follow illustrate the invention. Parts are by weight, and percentages are based on the weight of the materials, unless stated otherwise. The Examples in each case only state the surface content (surface concentration) of cyclic trimer, this being determined by the method of P. Kusch, Textilpraxis International 28 (1973), 96–98.

EXAMPLE 1

(a) Dyeing 1.1 kg of texturized polyester yarn, in the form of a muff, were dyed in a laboratory dyeing unit (type HS 30/2 from Rudolf Then, Schwäbisch Hall-Hessental), using an aqueous liquor which contained 1.5%, based on fiber weight, of a commercial formulation of the yellow disperse dye C.I. No. 47,023, 0.5 g/l of the sodium salt of a condensation product of naphthalenesulfonic acid and formaldehyde and 0.5 ml/l of 30% strength aqueous acetic acid. The liquor ratio was 20:1 and the liquor flowed outward through the material. Dyeing was complete after 1 hour at 130° C. After having cooled to 80° C., the liquor was drained off and the dyed polyester material was twice rinsed with water at 80° C.

(b) Reductive final cleaning

The dyed yarn was subsequently subjected to a reductive final cleaning in the dyeing unit, using an aqueous liquor which contained 3 g/l of sodium dithionite, 5 ml/l of an aqueous sodium hydroxide solution of 38° Be strength and 0.5 g/l of an adduct of 45 moles of ethylene oxide with 1 mole of castor oil. The liquor ratio was 20:1. The liquor flowed outward through the dyed material. The reductive cleaning was carried out at 70° C. and lasted 15 minutes. The yarn was rinsed with water at 70° C., neutralized with dilute acetic acid and then dried at 100° C. The dyed polyester material subjected to this reductive final cleaning contained 0.2% of the cyclic trimer in the inner layers of the muff and 0.15% in the outer layers, in each case based on the fiber weight.

(c) Removal of the oligomer deposits

The dyed material, after reductive final cleaning, was treated, in the laboratory dyeing unit, with a liquor which contained 4 g/l of a mixture of 25% of di-(iso-tridecyl)-dimethylammonium methosulfate, 25% of a reaction product obtained by quaternizing the adduct of 7 moles of ethylene oxide and 1 mole of oleylamine with dimethyl sulfate, 25% of isopropanol, 25% of water and 20 ml/l of sodium hydroxide solution of 38° Be strength. The liquor ratio was 20:1. The liquor was heated to 90° C. and the material was treated therein for 45 minutes. It was then rinsed, neutralized with dilute acetic acid and dried. No oligomer was detectable either in the inner or in the outer layers of the package.

EXAMPLE 2

A texturized polyester yarn was dyed as described in Example (1a) and then treated for 45 minutes at 90° C. with an aqueous liquor which contained 3 g/l of sodium dithionite, 20 ml/l of sodium hydroxide solution of 38° Bé strength, 0.5 g/l of an adduct of 45 moles of ethylene oxide with 1 mole of castor oil and 4 g/l of a mixture of 25% of tri-(iso-tridecyl)-methylammonium methosulfate, 25% of the reaction product obtained by quaternizing an adduct of 7 moles of ethylene oxide and 1 mole of oleylamine with dimethyl sulfate, 25% of isopropanol and 25% of water. After rinsing, neutralizing with dilute acetic acid and drying the material, no oligomer was detectable in the inner or outer layers of the package.

If, for comparison, the texturized polyester yarn dyed as described in Example (1a) was after-treated, under the above conditions, with an aqueous liquor which only contained 3 g/l of sodium dithionite, 20 ml/l of sodium hydroxide solution of 38° Bé strength and 0.5 g/l of an adduct of 45 moles of ethylene oxide with 1 mole of castor oil, the surface content of cyclic trimer, after rinsing with water and neutralizing with acetic acid, was 0.15% in the inner layers and 0.1% in the outer layers.

EXAMPLE 3

(a) Dyeing and reductive final cleaning

Following the dyeing method described in Example 1, a texturized polyester yarn was dyed with 1.5%, based on fiber weight, of a commercial formulation of the red disperse dye C.I. No. 11,116. The dyed material was then treated for 15 minutes at 80° C. with the reductive final cleaning liquor described in Example 1. After this treatment, the oligomer content was 0.2% in the inner layers and 0.15% in the outer layers.

(b) Removal of the oligomer deposits

To remove the oligomers from the material which had been dyed and subjected to the reductive final cleaning, the material was treated for 15 minutes at 80° C. with an aqueous liquor which contained 5 ml/l of sodium hydroxide solution of 38° Be strength and 4 g/l of a mixture of 25% of tri-(iso-decyl)-methylammonium methosulfate, 25% of coconut fatty acid γ-dimethylaminopropylamide, quaternized with epichlorohydrin, and 50% of isopropanol. The liquor ratio was 20:1. After rinsing and neutralizing with dilute acetic acid, no cyclic trimer was detectable on the polyester material.

(c) Removal of the oligomer during the reductive final cleaning

A tecturized polyester yarn in muff form was dyed with a commercial formulation of the red disperse dye C.I. No. 11,116 as described in Example 1 and was then treated for 15 minutes with an aqueous liquor, at 80° C., which contained 3 g/l of sodium dithionite, 5 ml/l of sodium hydroxide solution of 38° Bé strength, 0.5 g/l of an adduct of 45 moles of ethylene oxide with 1 mole of castor oil and 4 g/l of a mixture of 25% of tri-(isodecyl)-methylammonium methosulfate, 25% of coconut fatty acid γ-dimethylaminopropylamide, quaternized with epichlorohydrin, and 50% of isopropanol. The liquor ratio was 20:1. After rinsing, and neutralizing with dilute acetic acid, the surface content of cyclic trimer was 0.03%.

EXAMPLE 4

(a) Dyeing and reductive final cleaning 1.1 kg of a texturized polyester yarn in muff form was dyed for 60 minutes at 130° C. with an aqueous liquor which contained 3% of a commercial formulation of the red disperse dye C.I. No. 60,756, 0.5 g/l of the sodium salt of a condensation product of naphthalenesulfonic acid and formaldehyde, 0.5 ml/l of 30% strength aqueous acetic acid and 0.5 g/l of sodium ethylenediaminetetraacetate. The liquor ratio was 20:1 and the liquor flowed outward through the material. The liquor was drained off at 80° C. and the yarn was then rinsed twice with water at 80° C. Thereafter, the yarn was subjected to a reductive final cleaning by treating it for 20 minutes at 80° C. with an aqueous liquor which contained 10 ml/l of sodium hydroxide solution of 38° Be strength, 3 g/l of sodium dithionite and 0.5 g/l of an adduct of 45 moles of ethylene oxide with 1 mole of castor oil. The liquor ratio was 20:1 and the liquor flowed outward through the material. After rinsing the material with water at 70° C., neutralizing with dilute acetic acid and drying at 100° C., 0.15% of oligomer deposits was found in the inner and the outer layers of the muff.

(b) Removal of the oligomer deposits

In order to remove the oligomers, the yarn which had been dyed and subjected to a reductive final cleaning was treated for 20 minutes with a liquor, at 80° C., which contained 10 ml/l of sodium hydroxide solution of 38° Bé strength and 4 g/l of a mixture of 25% of tri-(n-octyl)-methylammonium chloride, 25% of coconut fatty acid γ-dimethylaminopropylamide, quaternized with benzyl chloride, and 50% of isopropanol. The liquor ratio was 20:1. After this treatment, only traces (less than 0.01%) of oligomers were present on the yarn surface.

If the yarn was treated with the same liquor for 30 minutes at 80° C., no detectable oligomer remained.

(c) Removal of the oligomer deposits during the reductive final cleaning

A texturized polyester yarn, in muff form, was dyed by the method described in Example (4a) and then subjected to the reductive final cleaning, the conditions specified for the reductive final cleaning in Example (4a) being employed, but with the additional presence in the liquor of 4 g/l of a mixture of 25% of tri-(n-octyl)-methylammonium chloride, 25% of coconut fatty acid γ-dimethylaminopropylamide, quaternized with benzyl chloride, and 50% of isopropanol. After rinsing and drying the polyester material which had been after-treated in this way, only traces (<0.01%) of the cyclic trimer remained detectable on the fiber surface.

EXAMPLE 5

(a) Dyeing and reductive final cleaning 600 g of polyester tops were dyed in a packing cage, using a liquor containing 1%, based on polyester, of a commercial formulation of the blue disperse dye C.I. No. 63,285, 0.5 g/l of the sodium salt of a condensation product of naphthalenesulfonic acid and formaldehyde and 0.5 ml/l of 30% strength aqueous acetic acid. The liquor ratio was 30:1. The dyeing process was carried out at 130° C. and was complete after 60 minutes. The liquor was drained off at 80° C. The dyed tops were then rinsed twice with water at 80° C., after which they were subjected to a reductive final cleaning with a liquor containing 3 g/l of sodium dithionite, 8 ml/l of sodium hydroxide solution of 38° Bé strength and 0.5 g/l of an adduct of 45 moles of ethylene oxide with 1 mole of castor oil. The reductive final cleaning was carried out for 20 minutes at 80° C. The tops were then rinsed, neutralized with dilute acetic acid and dried at 100° C. The concentration of the cyclic trimer was 0.05% (in the inner layers) and 0.1% (in the outer layers).

(b) Removal of the oligomers

To remove the oligomers from the fibers which had been dyed and subjected to the reductive final cleaning, the material was treated, in the dyeing apparatus, with an aqueous liquor which contained 8 g/l of a mixture of 25% of di-(iso-decyl)-dimethylammonium methosulfate, 25% of the product obtained by quaternizing an adduct of 7 moles of ethylene oxide and 1 mole of oleylamine with dimethyl sulfate, 25% of isopropanol and 25% of water, as well as 15 ml/l of sodium hydroxide solution of 38° Bé strength. The liquor ratio was 30:1. After 30 minutes exposure to the liquor at 80° C., and then rinsing with water, cyclic trimer was no longer detectable on the fiber surface.

(c) Removal of the oligomer deposits during the reductive final cleaning.

Polyester tops dyed as described in Example (5a) were treated for 30 minutes at 80° C. with an aqueous liquor which contained 15 ml/l of sodium hydroxide solution of 38° Bé strength, 3 g/l of sodium dithionite, 0.5 g/l of an adduct of 45 moles of ethylene oxide with 1 mole of castor oil and 8 g/l of a mixture of 25% of di-(iso-decyl)-dimethylammonium methosulfate, 25% of the product obtained by quaternizing an adduct of 7 moles of ethylene oxide and 1 mole of oleylamine with dimethyl sulfate, 25% of isopropanol and 25% of water. The liquor ratio was 30:1. After rinsing and drying the polyester tops, the surface content of cyclic trimer was found to be 0.02%.

EXAMPLE 6

Two lengths, each weighing 20 g, of a texturized polyester knitted fabric which has been cleaned with perchloroethylene were dyed in a Multicolor pressure-dyeing unit (from Pretema), by the following method:

1 g of the dye of the formula

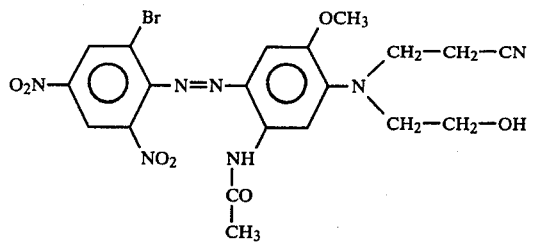

in its commercial form was dispersed in 300 ml of demineralized water. 3 g/l of a mixture of dichlorobenzenes and trichlorobenzenes (as the carrier) and 0.5 g/l of the sodium salt of a condensation product of naphthalenesulfonic acid and formaldehyde were also added and the pH was brought to 4.5 with acetic acid. The liquor was heated to 130° C. over 30 minutes and the fabric was dyed at this temperature for 60 minutes. After it had cooled to 90° C., the liquor was drained off and the fabric was rinsed once with water at about 80° C. It was then after-treated for 30 minutes at 80° C. with an aqueous liquor which contained 2 g/l of sodium dithionite, 10 ml/l of sodium hydroxide solution of 38° Bé strength and 4 g/l of a mixture of 25% of tri-(n-octyl)-methylammonium chloride, 25% of a reaction product obtained by quaternizing an adduct of 7 moles of ethylene oxide and 1 mole of oleylamine with dimethyl sulfate, 12.5% of isopropanol and 37.5% of water.

After the material had been rinsed, neutralized with dilute acetic acid and dried, only traces (less than 0.01%) of cyclic trimer were detectable on the innermost layer.

However, if for comparison the same dyeing was treated, under otherwise identical conditions, without adding the active ingredient mixture containing the quaternary ammonium compound, the surface content of cyclic trimer of the innermost layer, after rinsing and neutralizing, was 1.2%.

EXAMPLE 7

An untreated polyester knitted fabric was dyed with 1% of the dye C.I. No. 11,116 in its commercial form, by the method described in Example 6, except that 2 g/l of the mixture of dichlorobenzenes and trichlorobenzenes were employed. After the liquor had cooled to 80° C., 4 ml/l of sodium hydroxide solution of 38° Bé strength, 2 g/l of sodium dithionite and 0.5 g/l of an adduct of 45 moles of ethylene oxide with 1 mole of castor oil were added and the fabric was subjected to reductive cleaning for 20 minutes at 80° C. The liquor was drained off and the fabric was rinsed hot once and then treated for 30 minutes at 80° C. with a liquor which contained 10 ml/l of sodium hydroxide solution of 38° Bé strength and 2.3 g/l of a mixture of 22 parts of di-(n-$C_{16/18}$-alkyl)-dimethylammonium chloride, 22 parts of a reaction product obtained by quaternizing an adduct of 7 moles of ethylene oxide and 1 mole of oleylamine with dimethyl sulfate, 22 parts of isopropanol and 34 parts of water. After rinsing the knitted fabric, neutralizing it with dilute acetic acid and drying it, cyclic trimer was not detectable on the innermost layer of the package.

A fabric which had been dyed in the same manner but which, for comparison, had only been reductively cleaned, rinsed and dried, contained 0.23% of the cyclic trimer on the innermost layer.

EXAMPLE 8

The dyeing and after-treatment were carried out as described in Example 7, except that 9 g/l of a mixture of 22 parts of tri-(n-$C_{6/10}$-alkyl)-methylammonium methosulfate, 22 parts of the reaction product obtained by quaternizing an adduct of 7 moles of ethylene oxide and 1 mole of oleylamine with dimethyl sulfate, 22 parts of isopropanol and 34 parts of water was used. The content of cyclic trimer on the innermost layer was 0.05%.

EXAMPLE 9

An undyed polyester staple fiber yarn which had been set by treating it with saturated steam at 145° C. for 30 minutes, and which had a surface content of cyclic trimer of 0.25% was treated with a liquor which contained 10 ml/l of sodium hydroxide solution of 38° Bé strength and 8 g/l of a mixture of 25% of tri-(iso-octyl)-methylammonium methosulfate, 25% of the reaction product obtained by quaternizing an adduct of 7 moles of ethylene oxide and 1 mole of oleylamine with dimethyl sulfate, 25% of isopropanol and 25% of water. The liquor ratio was 15:1. After 15 minutes' treatment at 80° C., the yarn was rinsed, neutralized with dilute acetic acid and dried. The treated material had a surface content of cyclic trimer of 0.04%.

EXAMPLE 10

A liquor which contained 20 ml/l of sodium hydroxide solution of 38° Bé strength, 8 g/l of sodium dithionite, 8 g/l of a mixture of 25% of tri-(n-octyl)methylammonium methosulfate, 25% of the reaction product obtained by quaternizing an adduct of 7 moles of ethylene oxide and 1 mole of oleylamine with dimethyl sulfate, 25% of isopropanol and 25% of water, as well as 2 g/l of an adduct of 12 moles of ethylene oxide and 1 mole of oleylamine, was circulated for 30 minutes at 95° C. alternatively in both directions through a cheese dyeing machine which exhibited visible deposits of oligomers and dyes. The machine was then repeatedly rinsed with water, whereupon it was found to be free from the above deposits.

We claim:

1. A process for removing oligomer deposits from textile materials which consist of polyester fibers or of blends of polyester fibers with other fibers, and from dyeing machinery, comprising:

treating said fibers or machinery with an aqueous alkaline liquor at a temperature from 30° to 100° C., containing as the active ingredient of the liquor, at least one quaternary ammonium compound whose quaternary nitrogen atom bears not less than two $C_6$–$C_{22}$-alkyl or -alkenyl groups with the remaining groups being selected from the group consisting of alkyl, aryl, alkylphenyl, aralkyl, alkylene oxide and $RCO—X—(CH_2)_n—$, wherein R is $C_1$–$C_{18}$ alkyl, X is —NH— or —O— and n is a value from 1 to 6.

2. The process of claim 1, wherein said liquor is an emulsion of a quaternary ammonium compound whose quaternized nitrogen atom bears three $C_8$–$C_{14}$-alkyl groups.

3. The process of claim 1 or 2, wherein said aqueous liquor contains from 0.1 to 10 g/l of said quaternary ammonium compound.

4. The process of claim 1, wherein one of the substituents on the quaternary nitrogen atom of said quaternary ammonium compound is a $C_1$–$C_4$ alkyl group.

5. The process of claim 1, wherein said quaternary ammonium compound is selected from the group consisting of di-(iso-decyl)-dimethylammonium methosulfate, tri-(iso-decyl)-methylammonium methosulfate, tri-(n-octyl)-methylammonium chloride, tri-(n-octyl)-butylammonium chloride, tri-(n-octyl)-benzylammonium chloride, di-(isodecyl)-diethylammonium ethosulfate, tri-(n-dodecyl)-methylammonium iodide, di-(n-octyl)-methylbenzylammonium bromide, di-(iso-tridecyl)-dimethylammonium methosulfate, dipalmityl-benzyl-methylammonium chloride, dipalmityl-dimethylammonium chloride, distearyl-dimethylammonium chloride, di-(palm kernel alkyl)-methyl-benzylammonium chloride, dioleyl-dibutylammonium bromide, dioleyl-dimethylammonium chloride, dioleyl-benzyl-methylammonium chloride, tetra-(n-octyl)-ammonium bromide, tri-(n-octyl)-methylammonium hydroxide, 1,3,5-tris-(γ-didodecylmethyl-ammoniumpropyl)-hexahydrotriazine.

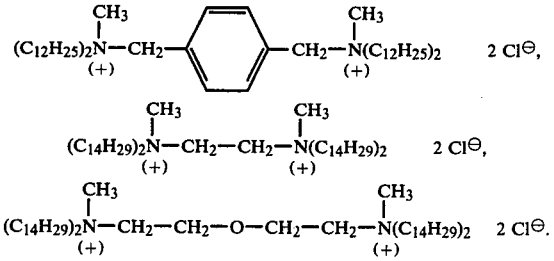

6. The process of claim 1, wherein said quaternary ammonium compound has the formula:

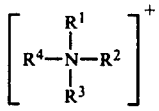

wherein $R^1$ and $R^2$ are $C_8$-$C_{18}$-alkyl or $C_8$-$C_{18}$-alkenyl, $R^3$ is $C_1$-$C_4$-alkyl, benzyl or phenyl or is as defined for $R^4$, $R^4$ is $[-CH_2-CH_2-O]_nH$, n is from 1 to 40 and $X^-$ is $Cl^-$, $Br^-$, $I^-$, $OH^-$, $CH_3OSO_3^-$, $C_2H_5OSO_3^-$ or $(CH_3O)_2PO_2^-$.

7. The process of claim 1, wherein said aqueous liquor has a pH of 8 to 14.

8. The process of claim 1, wherein said quaternary ammonium compound is self-emulsifying.

9. The process of claim 1, wherein said quaternary ammonium compounds is emulsified with a cationic, nonionic or anionic emulsifier.

10. The process of claim 9, wherein said cationic emulsifier is a quaternized oxyalkylated fatty amine or quaternized coconut fatty acid α-dimethylaminopropylamide and wherein said nonionic emulsifier is an oxyethylation product of a fatty alcohol, a $C_1$-$C_{12}$-alkylphenol, a fatty amine or a fatty acid or an oxyethylation product of castor oil.

* * * * *